US006523890B1

(12) United States Patent
Anderson

(10) Patent No.: US 6,523,890 B1
(45) Date of Patent: Feb. 25, 2003

(54) TWO-PIECE CHAIR AND TABLE SET

(76) Inventor: Norman C. Anderson, 141 Hillside Dr., South Windsor, CT (US) 06074

( * ) Notice: Subject to any disclaimer, the term of this patent is extended or adjusted under 35 U.S.C. 154(b) by 0 days.

(21) Appl. No.: 09/751,740

(22) Filed: Dec. 29, 2000

(51) Int. Cl.[7] ..... A47C 13/00
(52) U.S. Cl. ..... 297/118; 297/56; 297/158.3
(58) Field of Search ..... 297/118, 119, 297/140, 158.3, 16.1, 56, 57, 31, 447.2, 452.63, 157.1, 158.5; 108/67, 181, 153.1, 154, 156

(56) References Cited

U.S. PATENT DOCUMENTS

| | | | | | |
|---|---|---|---|---|---|
| 251,478 | A | * | 12/1881 | Smith | 297/56 |
| 2,537,127 | A | * | 1/1951 | Giberson | 297/158.3 |
| 2,873,793 | A | * | 2/1959 | Garcia | 297/57 |
| 2,897,876 | A | * | 8/1959 | Austin | 297/31 |
| 2,914,117 | A | | 11/1959 | Underwood | |
| 3,479,083 | A | * | 11/1969 | Lafer | 297/140 |
| 3,485,526 | A | | 12/1969 | Olitzky | |
| 3,514,154 | A | * | 5/1970 | Kotler | 297/158.3 |
| 3,650,560 | A | | 3/1972 | Wohlk | |
| 4,077,668 | A | | 3/1978 | Puccinelli | |
| 4,319,779 | A | * | 3/1982 | Leonhart | 297/56 X |
| 4,392,685 | A | * | 7/1983 | Leonhart | 297/119 |
| 4,890,881 | A | * | 1/1990 | Ollat et al. | 297/57 X |
| 5,282,664 | A | * | 2/1994 | Tseng | 297/31 |
| D355,546 | S | * | 2/1995 | Hewitt | D6/480 |
| D379,038 | S | * | 5/1997 | Yeh | D6/487 |
| D382,721 | S | | 8/1997 | Jacobi | |
| 5,813,721 | A | | 9/1998 | Arcidiacono | |
| D414,354 | S | * | 9/1999 | Gower | D6/484 |
| D436,757 | S | * | 1/2001 | Hutton | D6/470 |
| D440,080 | S | * | 4/2001 | Suzuki | D6/484 |
| D445,489 | S | * | 7/2001 | Ferrer Beltran | D23/286 |
| D448,211 | S | * | 9/2001 | Schulte et al. | D6/480 |

* cited by examiner

*Primary Examiner*—Peter M. Cuomo
*Assistant Examiner*—Stephen Vu

(57) ABSTRACT

A two-piece chair and furniture set for allowing the user to easily and quickly assembly and take apart the chairs and table assembly. The two-piece chair and furniture set includes chairs each having a backrest assembly including a backrest portion and a front legs portion; and also includes a seat assembly including a seat portion and a rear legs portion and being detachably attached to the backrest assembly; and further includes a table assembly including a base assembly and also including a tabletop assembly being mounted upon the base assembly.

3 Claims, 4 Drawing Sheets

TWO-PIECE CHAIR AND TABLE SET

BACKGROUND OF THE INVENTION

1. Field of the Invention

The present invention relates to a furniture set and more particularly pertains to a new two-piece chair and furniture set for allowing the user to easily and quickly assembly and take apart the chairs and table assembly.

2. Description of the Prior Art

The use of a furniture set is known in the prior art. More specifically, a furniture set heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. Des. 382,721; U.S. Pat. No. 4,077,668; U.S. Pat. No. 3,485,526: U.S. Pat. No. 2,914,117; U.S. Pat. No. 5,813,721; and U.S. Pat. No. 3,650,560.

While these devices fulfill their respective, particular objectives and requirements, the aforementioned patents do not disclose a new two-piece chair and furniture set. The inventive device includes chairs each having a backrest assembly including a backrest portion and a front legs portion; and also includes a seat assembly including a seat portion and a rear legs portion and being detachably attached to the backrest assembly; and further includes a table assembly including a base assembly and also including a tabletop assembly being mounted upon the base assembly.

In these respects, the two-piece chair and furniture set according to the present invention substantially departs from the conventional concepts and designs of the prior art, and in so doing provides an apparatus primarily developed for the purpose of allowing the user to easily and quickly assembly and take apart the chairs and table assembly.

SUMMARY OF THE INVENTION

In view of the foregoing disadvantages inherent in the known types of furniture set now present in the prior art, the present invention provides a new two-piece chair and furniture set construction wherein the same can be utilized for allowing the user to easily and quickly assembly and take apart the chairs and table assembly.

The general purpose of the present invention, which will be described subsequently in greater detail, is to provide a new two-piece chair and furniture set which has many of the advantages of the furniture set mentioned heretofore and many novel features that result in a new two-piece chair and furniture set which is not anticipated, rendered obvious, suggested, or even implied by any of the prior art furniture set, either alone or in any combination thereof.

To attain this, the present invention generally comprises chairs each having a backrest assembly including a backrest portion and a front legs portion; and also includes a seat assembly including a seat portion and a rear legs portion and being detachably attached to the backrest assembly; and further includes a table assembly including a base assembly and also including a tabletop assembly being mounted upon the base assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally and especially the scientists, engineers and practitioners in the art who are not familiar with patent or legal terms or phraseology to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new two-piece chair and furniture set which has many of the advantages of the furniture set mentioned heretofore and many novel features that result in a new two-piece chair and furniture set which is not anticipated, rendered obvious, suggested, or even implied by any of the prior art furniture set, either alone or in any combination thereof.

It is another object of the present invention to provide a new two-piece chair and furniture set which may be easily and efficiently manufactured and marketed.

It is a further object of the present invention to provide a new two-piece chair and furniture set which is of a durable and reliable construction.

An even further object of the present invention is to provide a new two-piece chair and furniture set which is susceptible of a low cost of manufacture with regard to both materials and labor, and which accordingly is then susceptible of low prices of sale to the consuming public, thereby making such two-piece chair and furniture set economically available to the buying public.

Still yet another object of the present invention is to provide a new two-piece chair and furniture set which provides in the apparatuses and methods of the prior art some of the advantages thereof, while simultaneously overcoming some of the disadvantages normally associated therewith.

Still another object of the present invention is to provide a new two-piece chair and furniture set for allowing the user to easily and quickly assembly and take apart the chairs and table assembly.

Yet another object of the present invention is to provide a new two-piece chair and furniture set which includes chairs each having a backrest assembly including a backrest portion and a front legs portion; and also includes a seat assembly including a seat portion and a rear legs portion and being detachably attached to the backrest assembly; and further includes a table assembly including a base assembly and also including a tabletop assembly being mounted upon the base assembly.

Still yet another object of the present invention is to provide a new two-piece chair and furniture set that is contoured for the body's natural seated posture.

Even still another object of the present invention is to provide a new two-piece chair and furniture set that is put together without complicated hardware and hinges.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
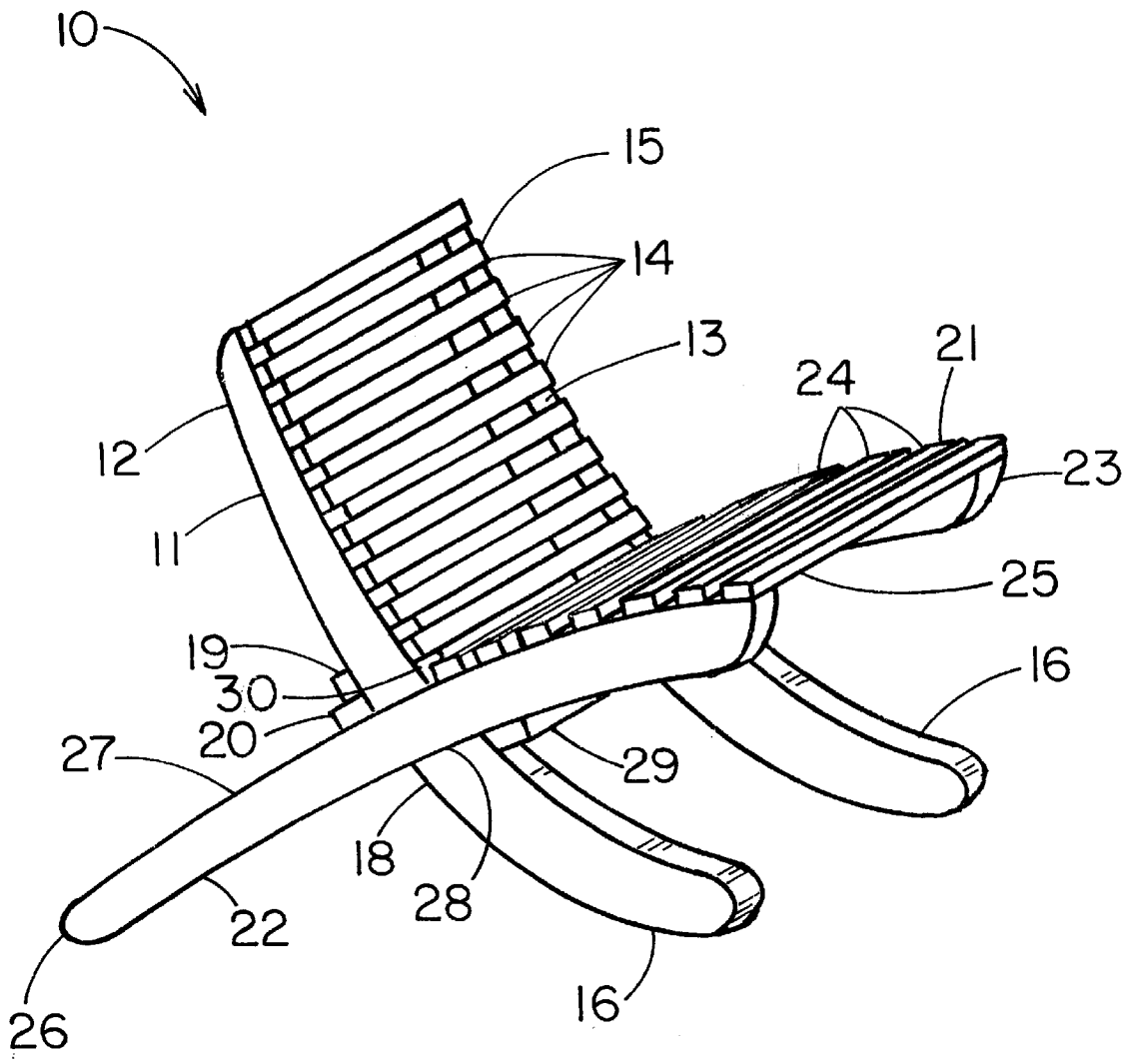
FIG. 1 is a perspective view of a new two-piece chair and furniture set according to the present invention.
Figure 2:
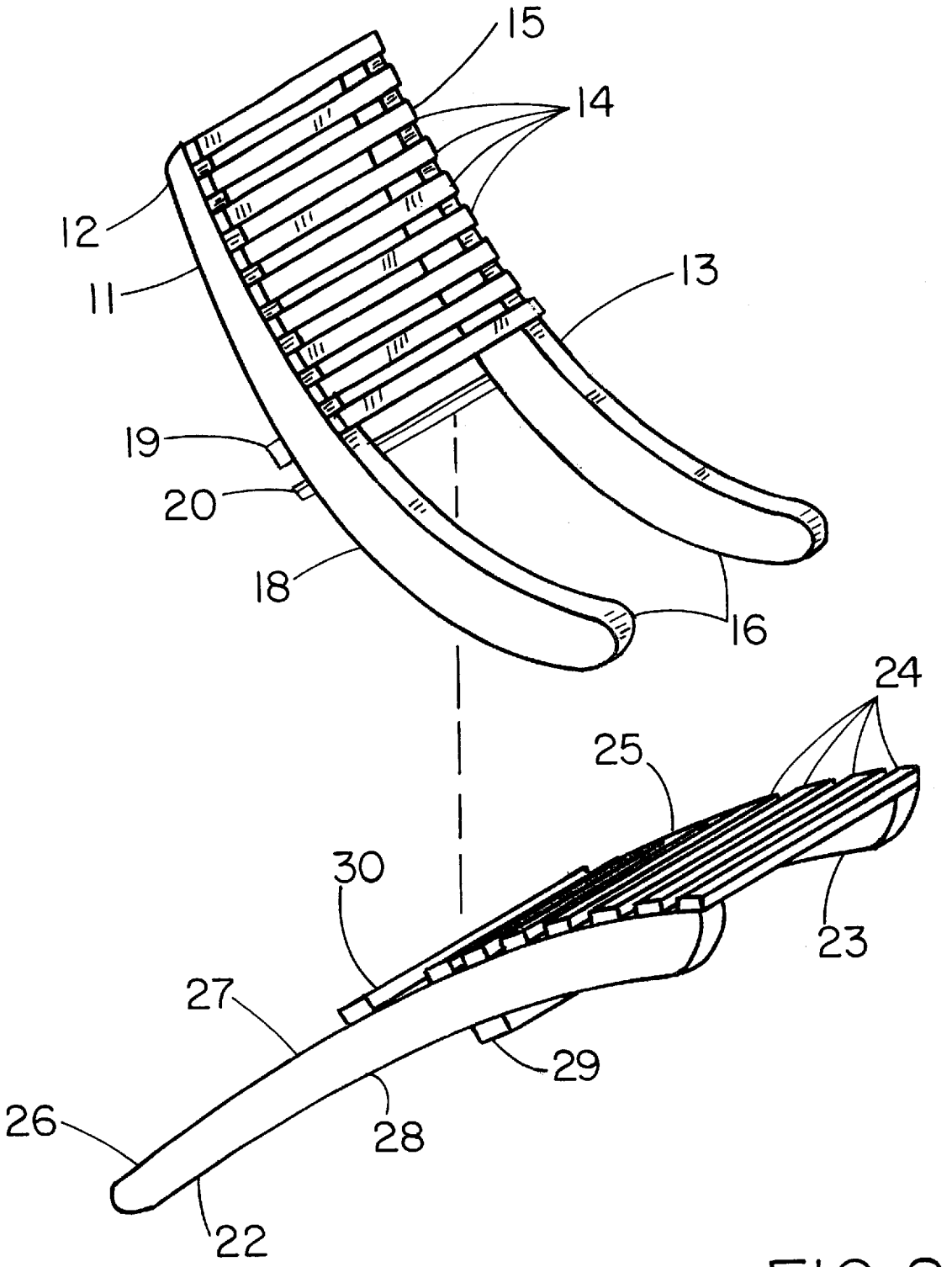
FIG. 2 is an exploded perspective view of the present invention.
Figure 5:
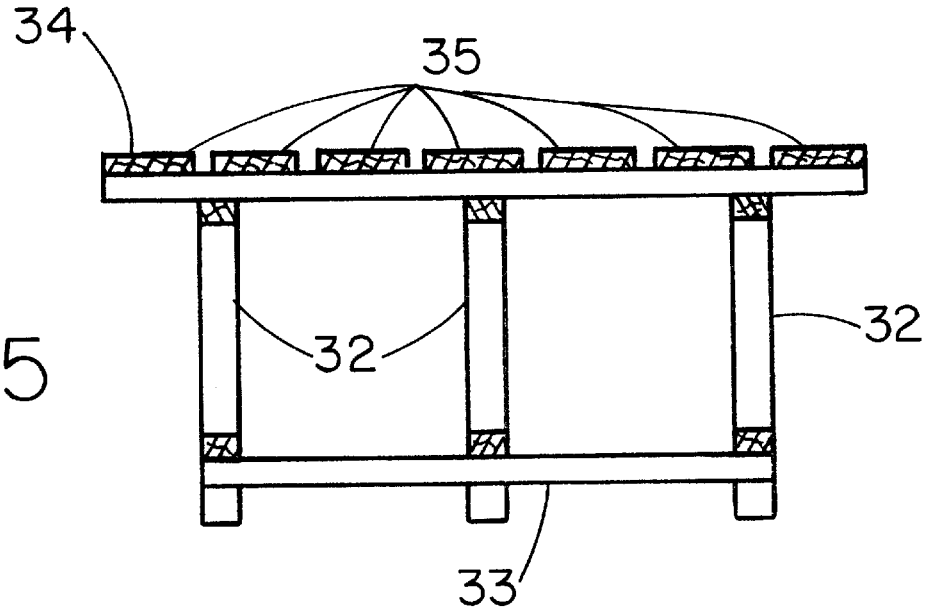
FIG. 5 is a side elevational view of the table of the present invention.
Figure 3:
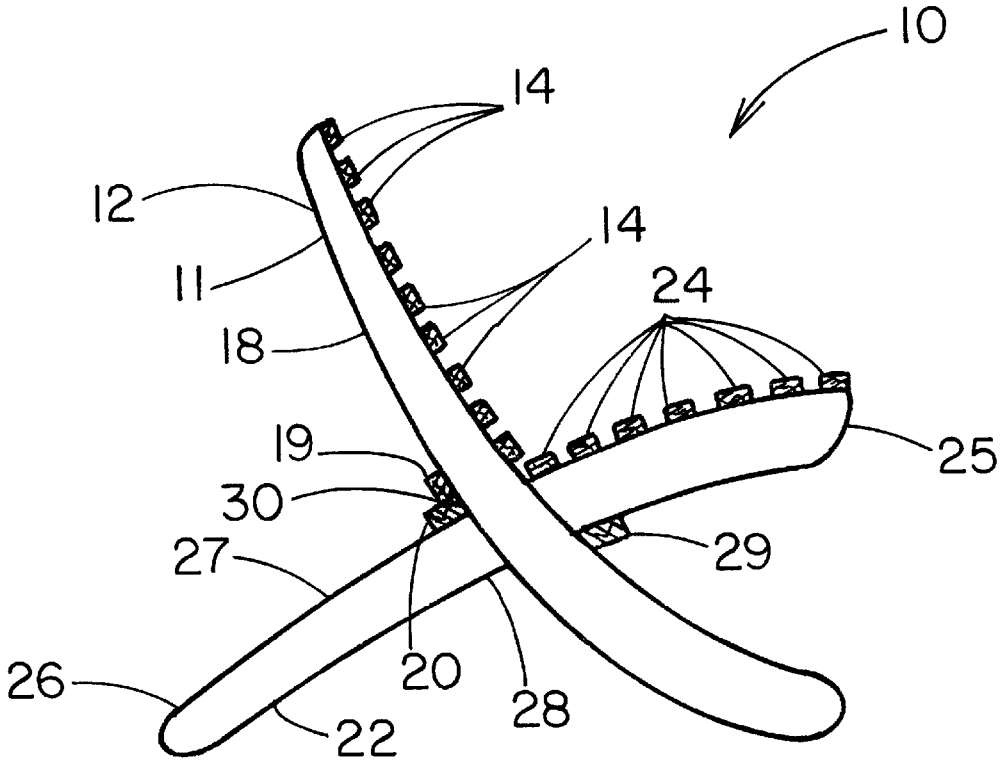
FIG. 3 is a side elevational view of the present invention.
Figure 4:
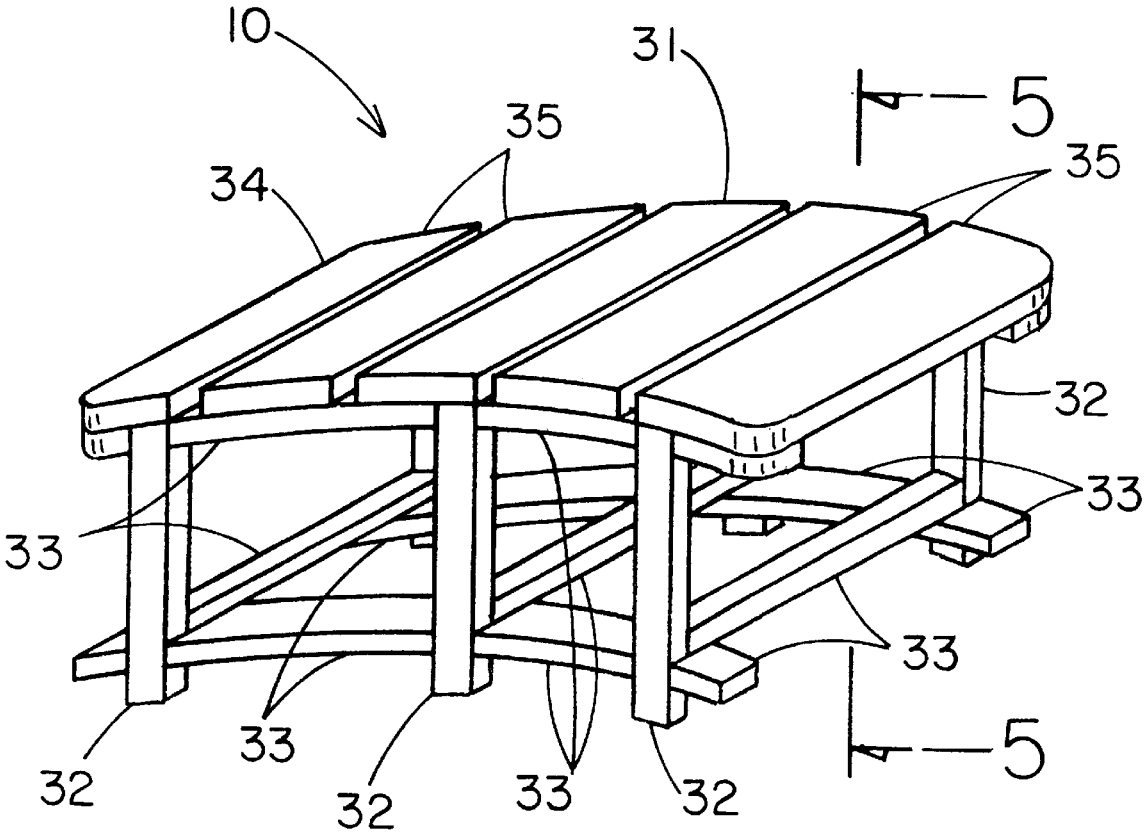
FIG. 4 is a perspective view of the table of the present invention.

With reference now to the drawings, and in particular to FIGS. 1 through 5 thereof, a new two-piece chair and furniture set embodying the principles and concepts of the present invention and generally designated by the reference numeral 10 will be described.

As best illustrated in FIGS. 1 through 5, the two-piece chair and furniture set 10 generally comprises chairs each having a backrest assembly 11 including a backrest portion 15 and a front legs portion 16. The backrest assembly 11 includes a pair of curved elongate side members 12, 13 being spaced apart, and also includes a plurality of elongate cross members 14 being spaced apart and being securely and conventionally attached to and along an upper portion of the curved elongate side members 12, 13 thus forming the backrest portion 15. Each of said elongate cross members 14 has end portions and also has recessed portions longitudinally disposed in the end portions with the elongate cross members 12, 13 being securely received in the recessed portions.

Each of the curved elongate side members 12, 13 also has a lower portion which is generally enlarged relative to the upper portion and which form the front legs portion 16. The backrest assembly 11 further includes a first brace member 19 being securely and conventionally attached to backsides 18 of the curved elongate side members 12, 13 near intermediate portions thereof, and also includes a second brace member 20 being securely and conventionally attached to the back sides 18 of the curved elongate side members 12, 13 near intermediate portions thereof and being spaced from the first brace member 19.

A seat assembly 21 includes a seat portion 25 and a rear legs portion 26 and being detachably and conventionally attached to the backrest assembly 11. The seat assembly 21 includes a pair of curved elongate side members 22,23 being spaced apart, and also includes a plurality of elongate cross members 24 being spaced apart and being securely and conventionally attached to and along an upper portion of the curved elongate side members 22,23 thus forming the seat portion 25. Each of said elongate cross members 24 has end portions and also has recessed portions longitudinally disposed in the end portions with the elongate cross members 22,23 being securely received in the recessed portions. The curved elongate side members 22,23 also have a lower portion which forms the rear legs portion 26. The seat assembly further includes a first brace member 29 being securely and conventionally attached to undersides 28 of the curved elongate side members 22,23 of the seat assembly 21 near intermediate portions thereof, and also includes a second brace member 30 being securely and conventionally attached to the upper sides 27 of the curved elongate side members 22,23 of the seat assembly 21 near intermediate portions thereof. The second brace member 30 of the scat assembly 21 is disposed between the first and second brace members 19,20 of the backrest assembly 11 with the second brace member 30 of the seat assembly 21 being engagable with the second brace member 20 of the backrest assembly 11.

A table assembly 31 includes a base assembly and a tabletop assembly 34 being conventionally mounted upon the base assembly. The base assembly including a plurality of leg members 32 and a plurality of cross members 33 conventionally interconnecting the leg members 32. The tabletop assembly 31 includes a tabletop having a plurality of board members 35 being spaced apart and being disposed side-by-side and being conventionally mounted upon the base assembly. The chairs are easily and conveniently stored on their sides between the tabletop assembly 31 and the cross member 33 of the base assembly of the table assembly 31.

In use, the user can easily and quickly assembly the two-piece chair and table set 10 and can use the furniture on the lawn or on the patio with the two-piece chair being contoured to fit the posture of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A two-piece chair and table set comprising:

a chair having a backrest assembly including a backrest portion and a front leg portion, and also having a seat assembly including a seat portion and a rear leg, portion and being detachably attached to said backrest assembly; and a table assembly including a base assembly and a tabletop assembly being mounted upon said base assembly;

wherein said backrest assembly includes a pair of curved elongate side members being spaced apart, and also includes a plurality of elongate cross members being spaced apart and being securely attached to and along an upper portion of said curved elongate side members thus forming said backrest portion, each of said elongate cross members having end portions and also having recessed portions longitudinally disposed in said end portions with said elongate cross members being securely received in said recessed portions;

wherein said curved elongate side members of said backrest assembly also have a lower portion which is generally enlarged relative to said upper portion and which form said front leg portion;

wherein said backrest assembly further includes a first brace member being securely attached to backsides of said curved elongate side members near intermediate portions thereof, and also includes a second brace member being securely attached to front sides of said curved elongate side members near intermediate portions thereof;

wherein said seat assembly includes a pair of curved elongate side members being spaced apart, and also includes a plurality of elongate cross members being spaced apart and being securely attached to and along an upper portion of said curved elongate side members thus forming said seat portion, each of said elongate cross members having end portions and also having recessed portions longitudinally disposed in said end portions with said elongate cross members being securely received in said recessed portions; wherein said curved elongate side members of said seat assembly also have a lower portion which forms said rear legs portion;

wherein said seat assembly further includes a first brace member being securely attached to undersides of said curved elongate side members of said seat assembly near intermediate portions thereof, and also includes a second brace member being securely attached to said upper sides of said curved elongate side members of said seat assembly near intermediate portions thereof, said first brace members of said backrest assembly being engagable with said second brace members of said seat assembly, said second brace members of said backrest assembly being engagable with said first brace members of said seat assembly; and wherein said base assembly includes a plurality of leg members and a plurality of cross members interconnecting said leg members.

2. The two-piece chair and table set as described in claim 1, wherein said tabletop assembly includes a tabletop having a plurality of board members being spaced apart and being disposed side-by-side and being mounted upon said base assembly, said chairs being storable between said tabletop assembly and said cross members of said base assembly.

3. A two-piece chair and table set comprising:

a plurality of chairs each having a backrest assembly including a backrest portion and a front leg portion, said backrest assembly including a pair of curved elongate side members being spaced apart, and also including a plurality of elongate cross members being spaced apart and being securely attached to and along an upper portion of said curved elongate side members thus forming said backrest portion, each of said elongate cross members having end portions and also having recessed portions longitudinally disposed in said end portions with said elongate: cross members being securely received in said recessed portions, said curved elongate side members also having a lower portion which is generally enlarged relative to said upper portion and which form said front leg portion, said backrest assembly further including a first brace member being securely attached to backsides of said curved elongate side members near intermediate portions thereof, and also including a second brace member being securely attached to said front sides of said curved elongate side members near intermediate portions thereof, and each of said chairs also has a seat assembly including a seat portion and a rear legs portion and being detachably attached to said backrest assembly, said seat assembly including a pair of curved elongate side members being spaced apart, and also including a plurality of elongate cross members being spaced apart and being securely attached to and along an upper portion of said curved elongate side members thus forming said seat portion, each of said elongate cross members having end portions and also having recessed portions longitudinally disposed in said end portions with said elongate cross members being securely received in said recessed portions, said curved elongate side members also having a lower portion which forms said rear leg portion, said seat assembly further including a first brace member being securely attached to undersides of said curved elongate side members of said seat assembly near intermediate portions thereof, and also including a second brace member being securely attached to said upper sides of said curved elongate side members of said seat assembly near intermediate portions thereof, said first brace member of said backrest assembly being engagable with said second brace member of said seat assembly, said second brace member of said backrest assembly being engagable with said first brace members of said seat assembly; and a table assembly including a base assembly and a tabletop assembly being mounted upon said base assembly, said base assembly including a plurality of leg members and a plurality of cross members interconnecting said leg members, said tabletop assembly including a tabletop having a plurality of board members being spaced apart and being disposed side-by-side and being mounted upon said base assembly, said chairs being storable between said tabletop assembly and said cross members of said base assembly.

* * * * *